US012588752B2

(12) United States Patent
Goldenberg et al.

(10) Patent No.: US 12,588,752 B2
(45) Date of Patent: Mar. 31, 2026

(54) SLIDING DESK

(71) Applicant: Brinkley RV LLC, Goshen, IN (US)

(72) Inventors: Nathan Goldenberg, Granger, IN (US); Barry Ousley, Syracuse, IN (US)

(73) Assignee: Brinkley RV LLC., Goshen, IN (US)

( * ) Notice: Subject to any disclaimer, the term of this patent is extended or adjusted under 35 U.S.C. 154(b) by 91 days.

(21) Appl. No.: 18/895,923

(22) Filed: Sep. 25, 2024

(65) Prior Publication Data

US 2025/0098847 A1 Mar. 27, 2025

Related U.S. Application Data

(60) Provisional application No. 63/540,212, filed on Sep. 25, 2023.

(51) Int. Cl.

| | |
|---|---|
| ***A47B 1/05*** | (2006.01) |
| ***A47B 1/03*** | (2006.01) |
| ***A47B 1/10*** | (2006.01) |
| ***A47B 13/08*** | (2006.01) |

(52) U.S. Cl.

CPC ..... *A47B 1/05* (2013.01); *A47B 1/10* (2013.01); *A47B 13/081* (2013.01); *A47B 2001/035* (2013.01)

(58) Field of Classification Search

CPC .... A47B 1/05; A47B 1/08; A47B 1/10; A47B 13/081; A47B 2001/035

See application file for complete search history.

(56) References Cited

U.S. PATENT DOCUMENTS

| | | | | |
|---|---|---|---|---|
| 5,666,887 | A * | 9/1997 | Grabowski | A47B 21/06 108/93 |
| 5,688,154 | A * | 11/1997 | Goda | C09D 11/06 428/914 |
| 10,568,414 | B1 * | 2/2020 | Glattstein | A47B 46/00 |
| 10,709,234 | B1 * | 7/2020 | Brennan | A47B 41/02 |
| 11,083,284 | B1 * | 8/2021 | Koga | A47B 13/081 |
| 11,406,178 | B1 * | 8/2022 | Medanich | A47B 25/00 |
| 2010/0101461 | A1 * | 4/2010 | Brault | A47B 13/003 108/140 |
| 2013/0047898 | A1 * | 2/2013 | Lee | A47B 1/03 108/86 |
| 2013/0284075 | A1 * | 10/2013 | Reithler | A47B 21/03 108/91 |
| 2017/0238696 | A1 * | 8/2017 | Ehrreich | A47B 9/20 |
| 2017/0367475 | A1 * | 12/2017 | Carrera Gonzalez | A47B 17/065 |
| 2024/0074575 | A1 * | 3/2024 | Cubrilovic | A47B 1/05 |
| 2024/0130516 | A1 * | 4/2024 | Yang | A47B 1/04 |

* cited by examiner

*Primary Examiner* — Daniel J Rohrhoff

(74) *Attorney, Agent, or Firm* — Sanders Pianowski LLP

(57) ABSTRACT

A stowable sliding desk has a fixed portion and a moveable portion that is coupled to the fixed portion. The moveable portion is slidable with respect to the fixed portion and expandable in a direction perpendicular to the length of the fixed portion. The moveable portion has a fixed leaf and a hinged leaf coupled thereto that either overlays the fixed leaf or is abutting and coplanar to the fixed leaf. A hidden leaf is slidable to extend the useable area of the moveable portion when the hinged leaf is coplanar to the fixed leaf.

20 Claims, 10 Drawing Sheets

SLIDING DESK

CROSS REFERENCE TO RELATED APPLICATIONS

This application claims the benefit of Provisional Application Ser. No. 63/540,212, filed Sep. 25, 2023, the disclosure of which is incorporated by reference.

BACKGROUND OF THE INVENTION

The present disclosure relates to tables, desks, work surfaces, or platforms used with mobile living quarters, such as recreational vehicles, trailers, or campers. In these vehicles, space is at a premium, and certain areas of the vehicle will serve multiple purposes throughout the day. Therefore, it is advantageous to be able to easily reconfigure an area. Previously, platforms like these would be attached to the floor of the vehicle with a post, and to reconfigure the space, the platform would need to be removed from the post to be repurposed or relocated. Other designs are difficult to operate and don't provide sufficient flexibility. Therefore, an improved platform system is needed.

SUMMARY OF THE INVENTION

The present disclosure describes a configurable table or desk that is attached to mobile living quarters. The desk has a fixed portion and a moveable portion that is coupled to the fixed portion. The moveable portion is capable of sliding and/or telescoping with respect to the fixed platform. The configurable desk comprises a fixed surface with a front edge, a back edge opposite to the front edge, and side edges extending between the front and back edges. A rod having a central axis is affixed to the fixed surface adjacent to the back edge. The moveable portion is coupled to the rod and is slidable along the central axis.

The moveable portion comprises a first telescoping frame having a proximal section located at a fixed distance from said rod and a distal section telescopically extendable with respect to said proximal section between a collapsed position and an extended position. The moveable portion includes an attached leaf fixed with respect to the distal section of the first telescoping frame. A support leg is affixed to the end with the attached leaf. An invertible leaf is hinged to the attached leaf and is pivotable between an abutted position and an overlaying position. The abutted position is defined by one edge of the invertible leaf abutting one edge of the attached leaf. The overlaying position is defined by the invertible leaf inverted with respect to its abutted position and overlaying the attached leaf. The moveable portion also includes a second telescoping frame having a proximal section located at a fixed distance from the rod and a distal section telescopically extendable with respect to the proximal section between a collapsed position and an extended position. A hideaway leaf is affixed to the distal section of the second telescoping frame. The hideaway leaf is moveable between a hidden position and a use position, with the hidden position defined by the fixed surface overlaying the hideaway leaf and the use position defined by at least a portion of the hideaway leaf extending beyond the front edge. Lastly, when the invertible leaf is in the overlaying position, the first telescoping frame is movable to the collapsed position.

DESCRIPTION OF THE PREFERRED EMBODIMENT

Figure 1:
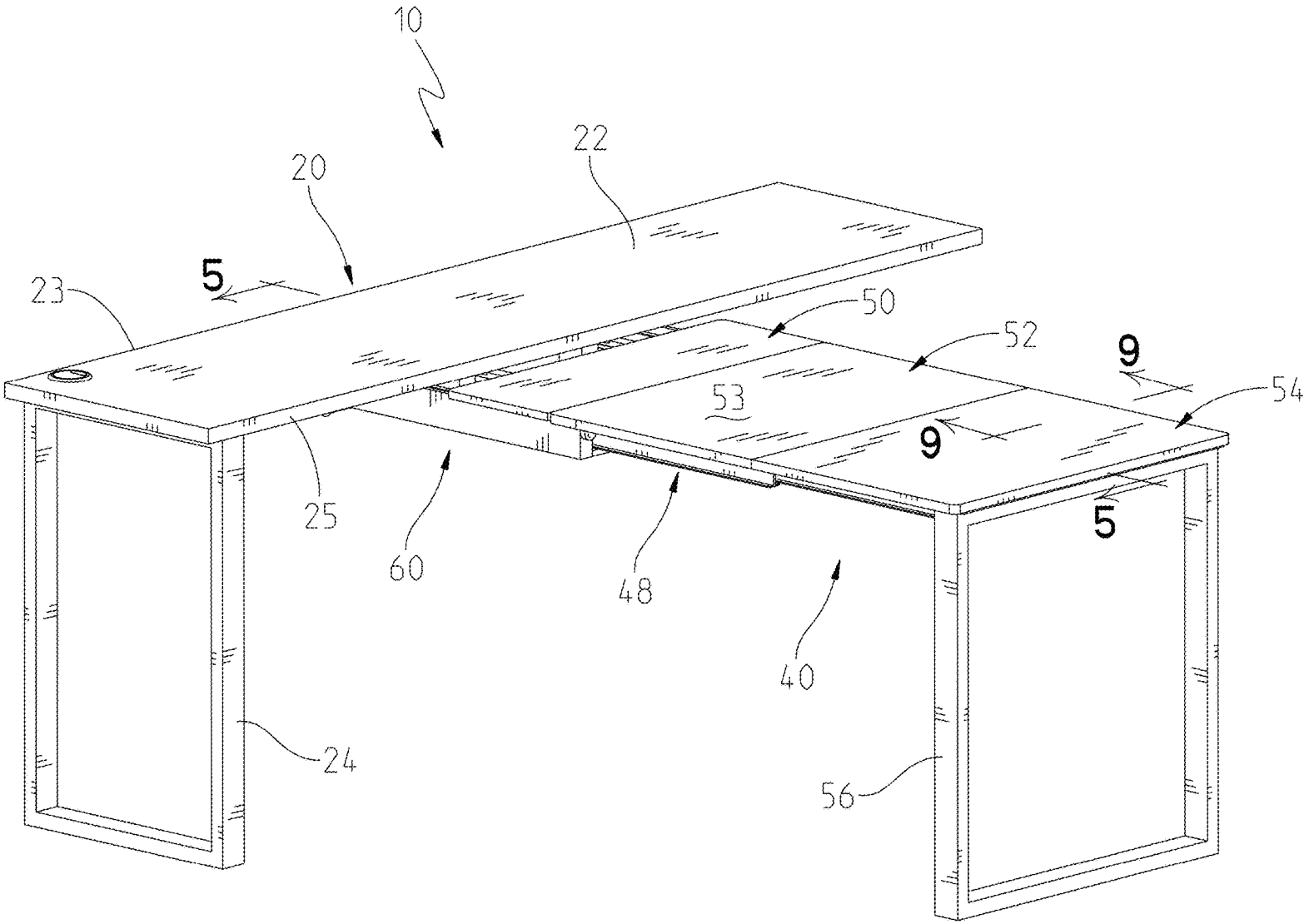
FIG. 1 is a top isometric view of the sliding desk in the fully expanded position.

A reconfigurable and sliding desk 10 is shown in FIGS. 1-7. The desk 10 has a fixed portion 20 and a moveable portion 40. The fixed portion 20 is attached to mobile living quarters (not shown), such as an RV, travel trailer, camper, or 5th wheel. The fixed portion 20 has a flat work surface 22 and a fixed support leg 24. The work surface 22 has a back edge 23 and a front edge 25, with the back edge 23 secured to the wall of the mobile living quarters with fasteners, brackets, or equivalent. The front edge 25 is clear of obstructions and unsupported, except by the fixed support leg 24 on one end and other structure on the other end. As shown, the end of the flat work surface 22 with the fixed support leg 24 is supported by the support leg 24, and the opposite end is affixed to a wall or other load-bearing structure. While not shown, it is contemplated that a second fixed support leg supports the opposite end. It is further contemplated that the work surface 22 is affixed between walls, furniture, or other fixtures in the mobile living quarters on each end and there is no fixed support leg 24. Under the work surface 22 is a rod 26 that is attached through mounting blocks 28, 30. The rod 26 is shown as cylindrical but other shapes, channels, or extrusions are contemplated. The rod 26 is attached close to the back edge 23, spans uninterrupted between the mounting blocks 28, 30, and supports part of the moveable portion 40. The rod 26 is shown as only extending along a portion of the flat work surface 22, but it is contemplated that it extends along the entire length.

Figure 2:
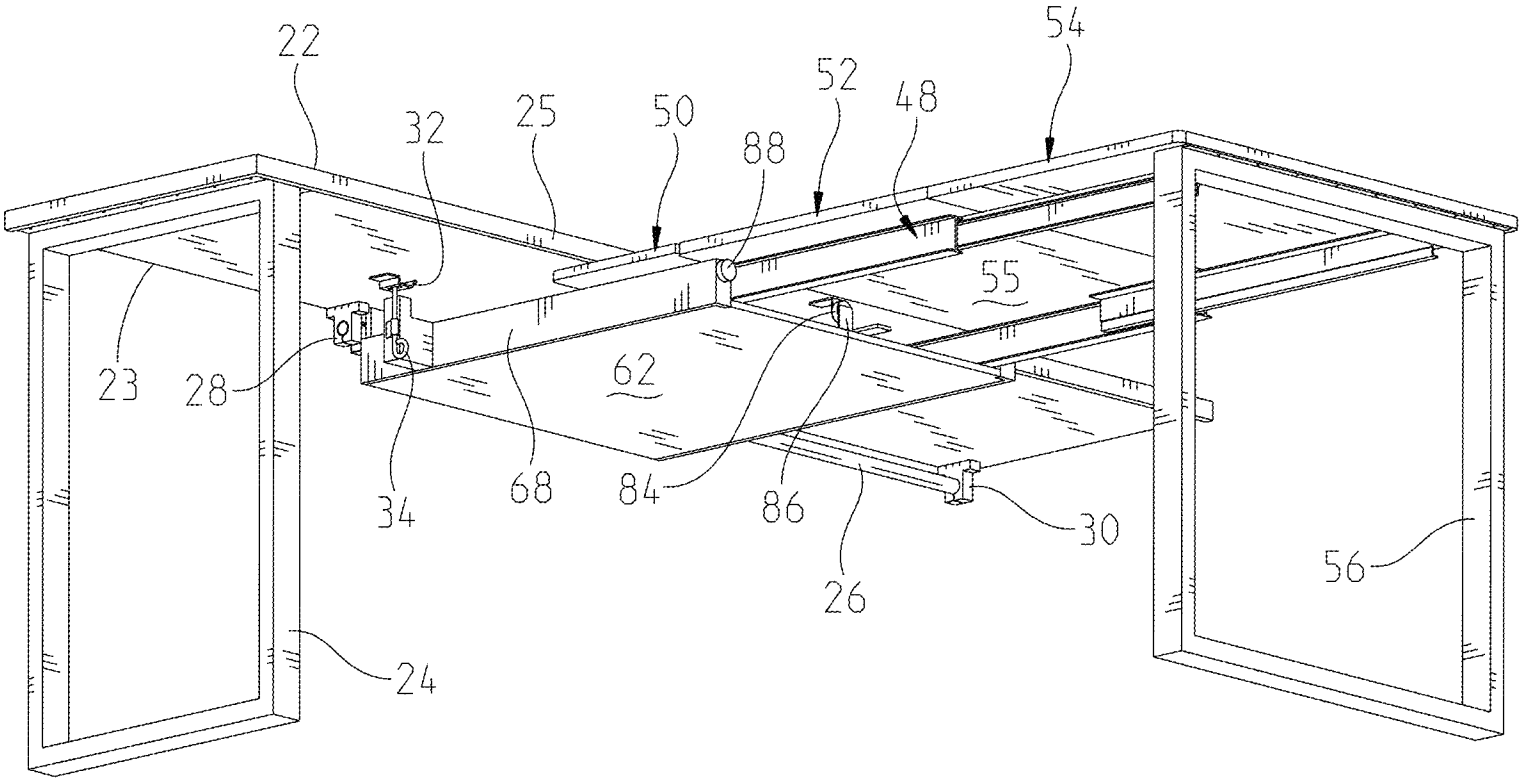
FIG. 2 is a bottom isometric view of the sliding desk in FIG. 1.
Figure 3:
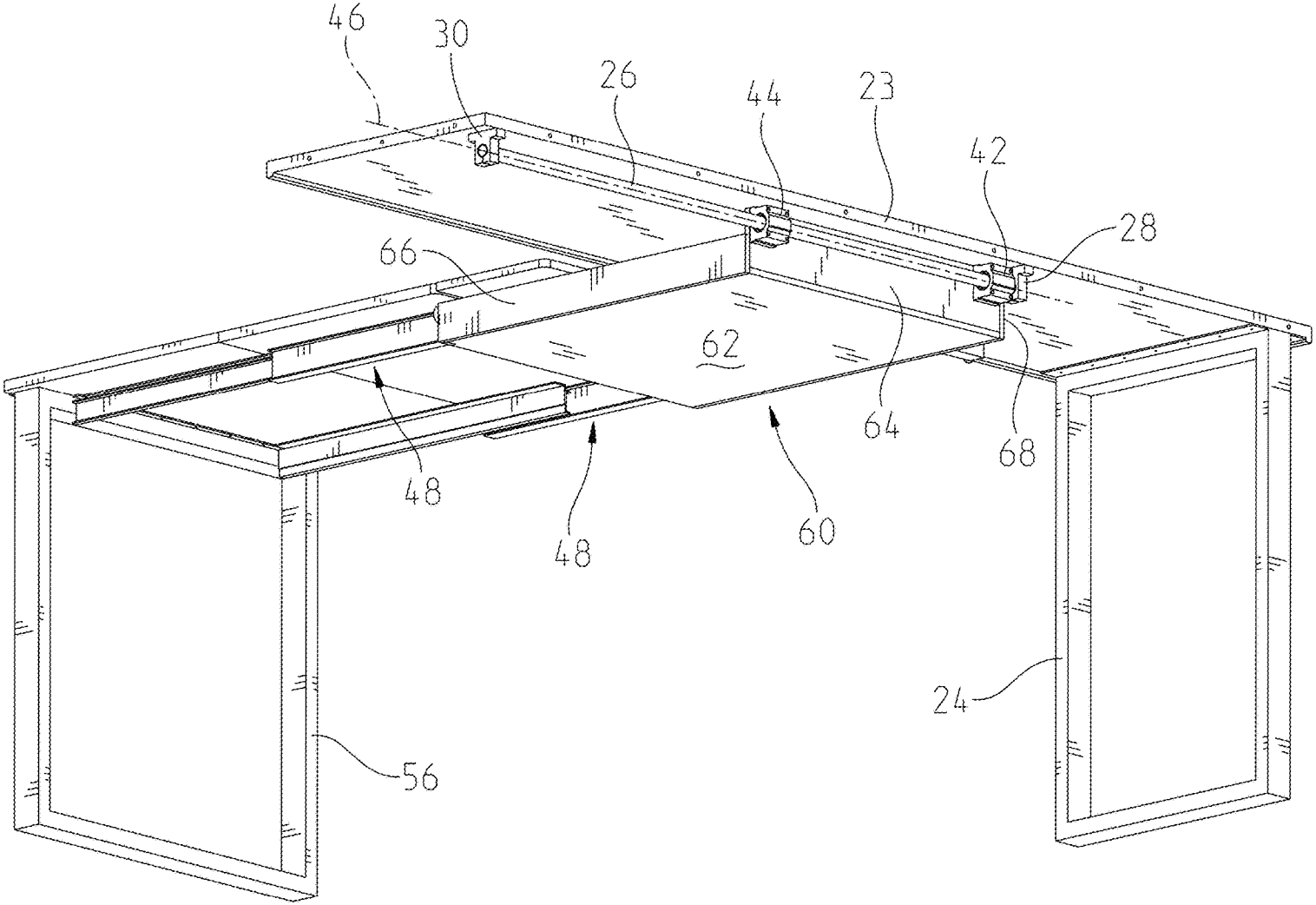
FIG. 3 is a bottom rear isometric view of the sliding desk in FIG. 1.
Figure 4:
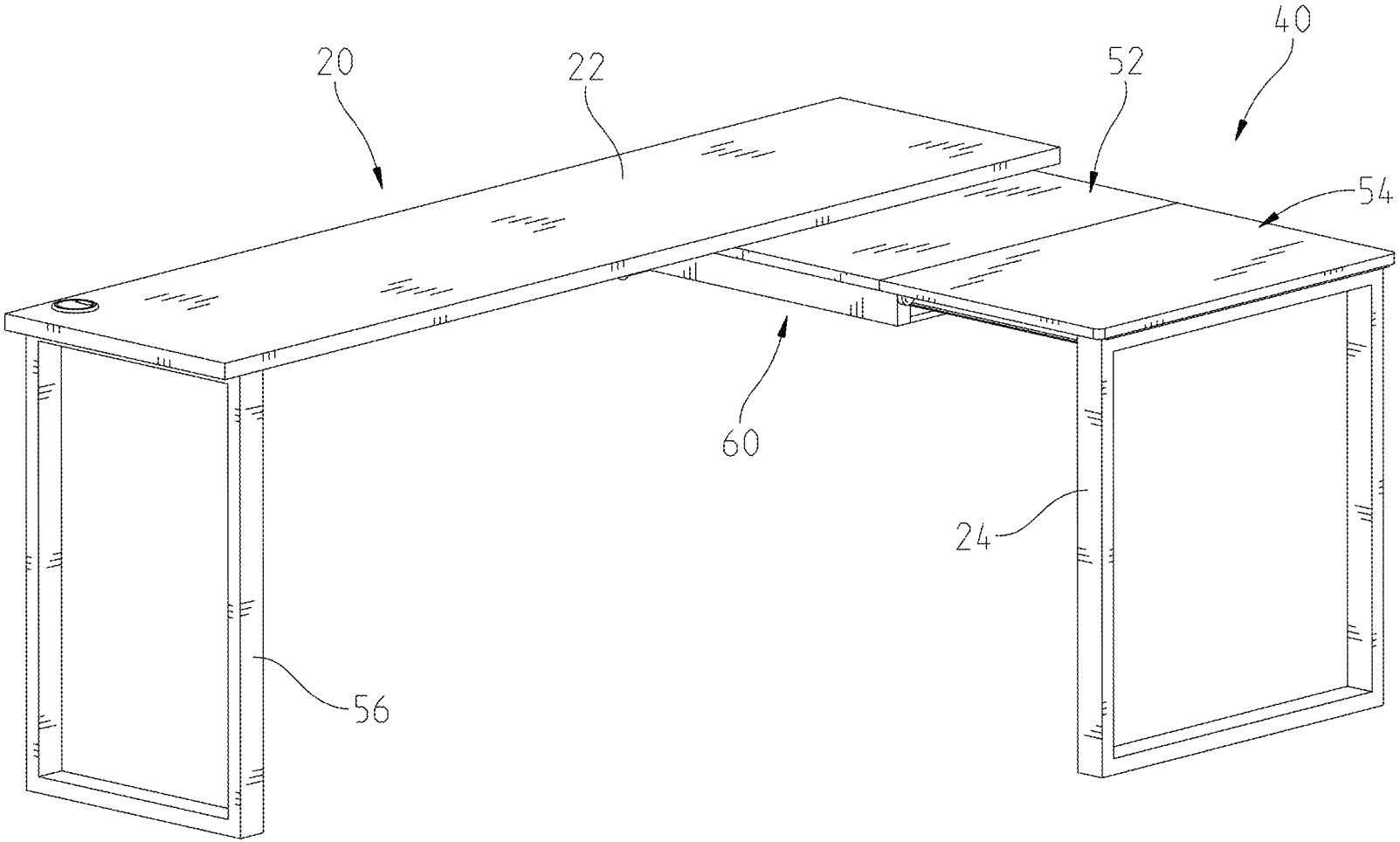
FIG. 4 is an isometric view of the sliding desk in FIG. 1 with the hideable leaf hidden.
Figure 5:
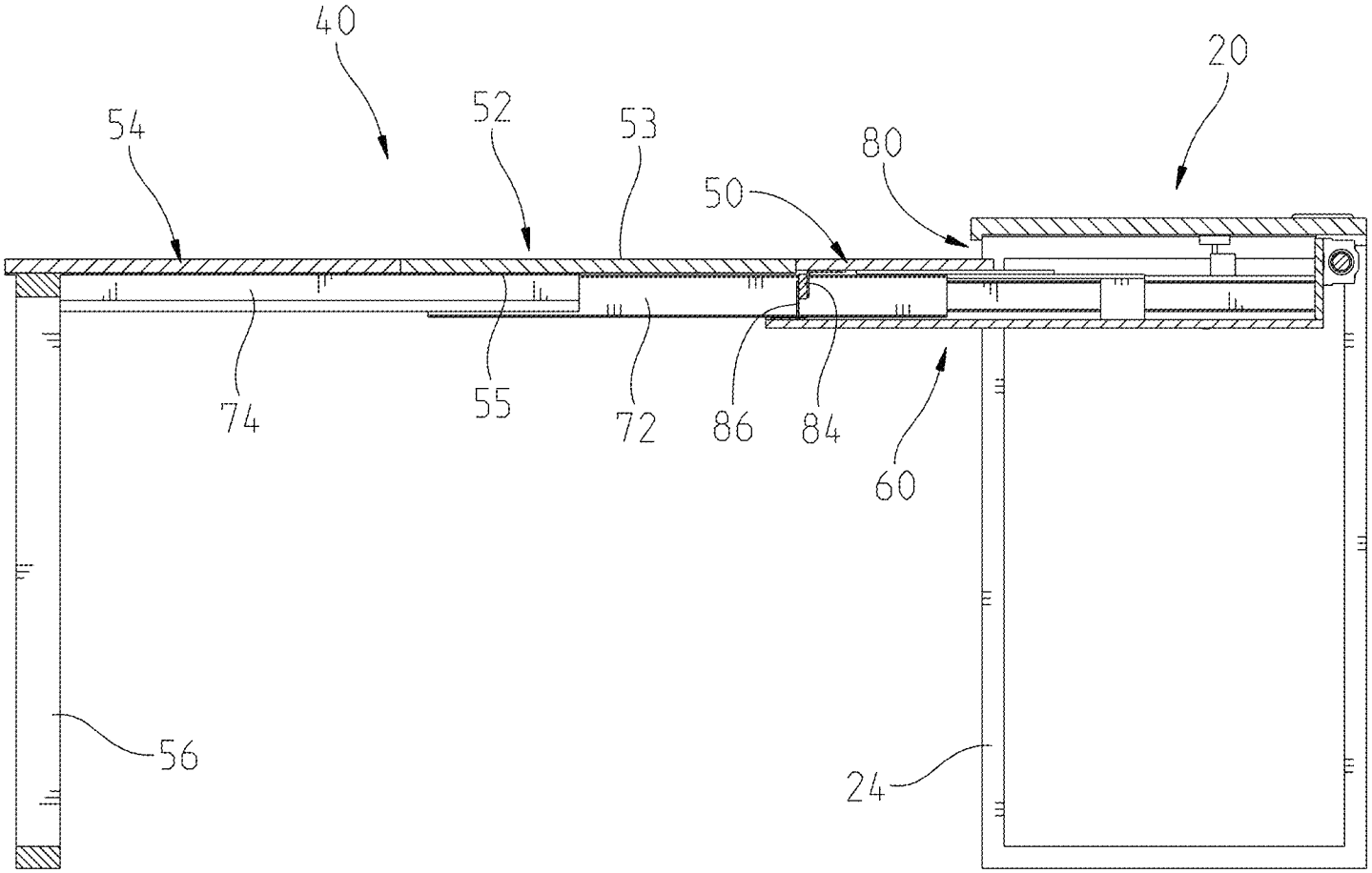
FIG. 5 is a section view 5-5 of the sliding desk in FIG. 1 fully expanded.
Figure 6:
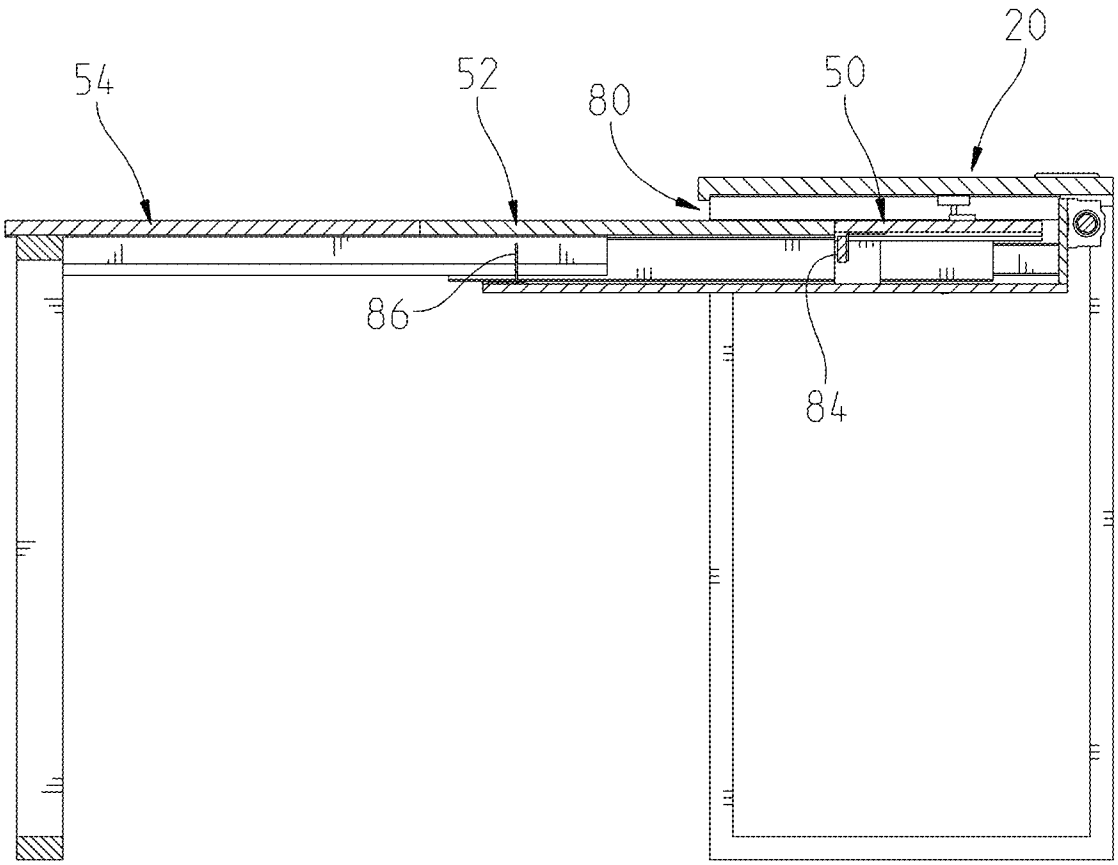
FIG. 6 is a section view 5-5 of the sliding desk in FIG. 1 partially collapsed.
Figure 7:
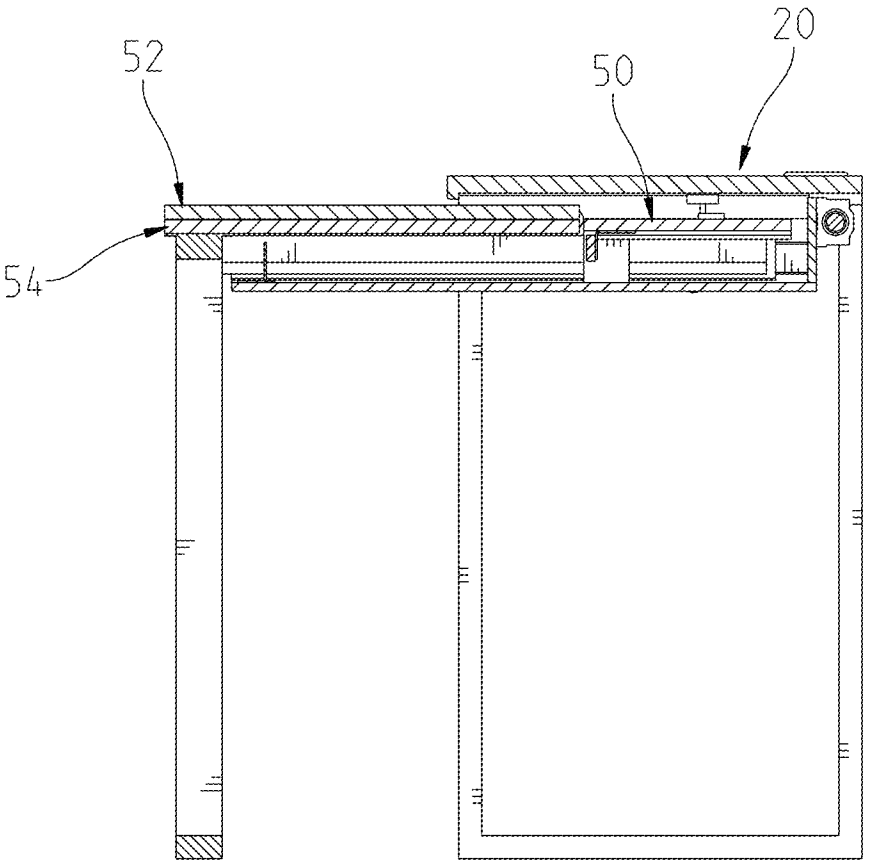
FIG. 7 is a section view 5-5 of the sliding desk in FIG. 1 fully collapsed.
Figure 8:
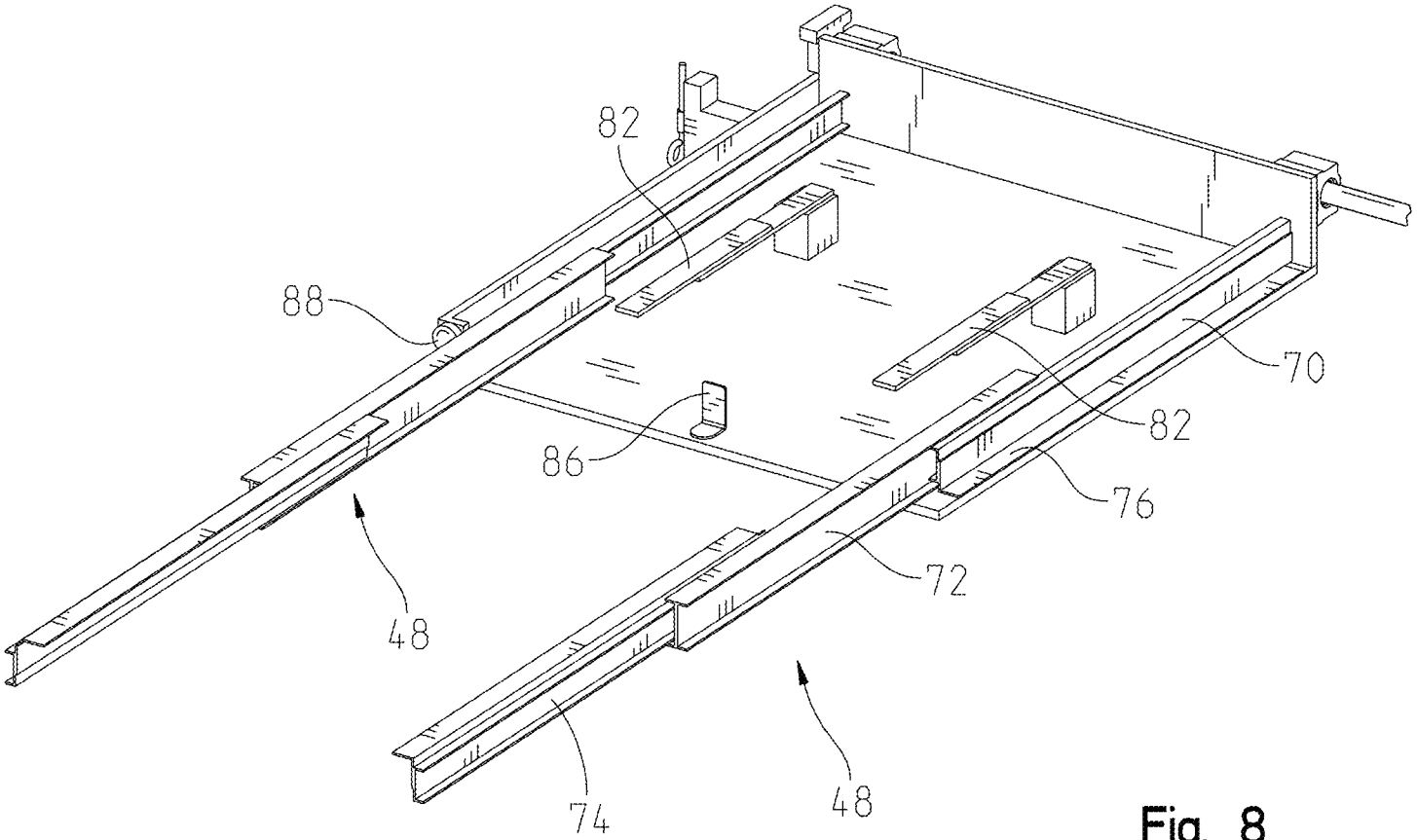
FIG. 8 is a partial view of the telescoping mechanism in FIG. 2 with the leaves and fixed portion removed.
Figure 10:
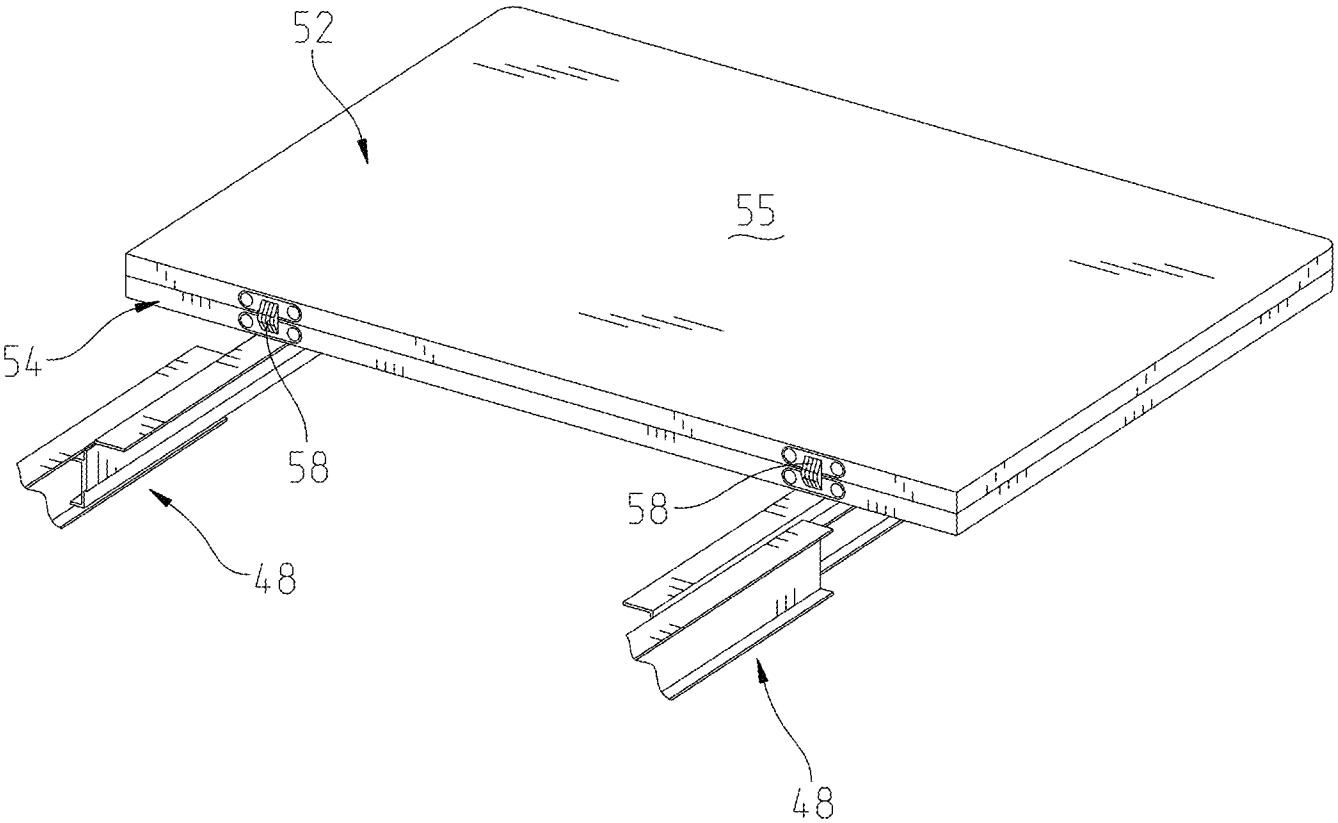
FIG. 10 is a rear isometric view of the invertible leaf in the overlaying position.

The moveable portion 40 connects to the rod 26 with bearing blocks 42, 44 that allow sliding along a sliding axis 46 and is lockable in a first position, shown in FIG. 1, and a second position, shown in FIG. 4. First and second ramped locking plates 32 are affixed to the underside of the fixed portion 20 and a spring-loaded locking pin 34 is affixed to the moveable portion 40, shown in FIG. 2. In addition to sliding along the sliding axis 46, the moveable portion 40 expands in a direction perpendicular to the sliding axis 46 to a fully extended position, shown in FIGS. 1-3 and 5. The moveable portion 40 can also be configured and compressed into a fully stored position, shown in FIG. 7. In the stored position, only a small portion of the moveable portion 40 extends beyond the front edge 25 of the work surface 22. The sliding of the moveable portion 40 along axis 46 does not depend on whether it is extended, compressed, or any position in between. In the fully extended position, a secondary work surface is formed by leaves 50, 52, 54. A telescoping mechanism 48 is attached to the bearing blocks 42, 44 and is extendable and collapsible in a direction perpendicular to the sliding axis 46. The moveable portion 40 includes a hideaway leaf 50 that is useable when the telescoping mechanism 48 is fully extended. The hideaway leaf 50 is affixed to a second telescoping mechanism 82 that allows the hideaway leaf 50 to move between a hidden position, shown in FIGS. 6-7 and a use position, shown in FIGS. 1-3 and 5. As can be seen in FIGS. 5 and 6, the hideaway leaf 50 has a top surface that is coplanar with the top surfaces of the invertible leaf 52 and attached leaf 54. A pivotably invertible leaf 52 is connected to the attached leaf 54 with a hinge 58, shown in FIG. 10. In the embodiment shown herein, the hinge 58 is hidden/concealed such that when the invertible leaf 52 is pivoted as shown in FIG. 1, the hinge does not protrude or interrupt the useable surface area. The invertible leaf 52 is pivotable between an abutting position, shown in FIGS. 1-6 and an overlaying position, shown in FIGS. 7 and 10. The invertible leaf 52 has a first work surface 53 and an oppositely located second work surface 55. Both work surfaces 53, 55 are planar and free of mechanisms, tracks, mounting features, or other interruptions. In other words, the invertible leaf 52 can be used as a work surface in either position. In the abutting position, one edge of the invertible leaf 52 abuts the attached leaf 54 and the first work surface 53 is coplanar with the work surface of the attached leaf 54. In the overlaying position, the invertible leaf 52 is inverted and overlays the attached leaf 54. The moveable portion 40, specifically the attached leaf 54, is supported by a support leg 56. The bearing blocks 42, 44 and rod 26 may allow limited rotation around the sliding axis 46 so the user can lift the support leg 56 when sliding the moveable portion 40 along the sliding axis 46. A protective cover 60 is shown in FIGS. 2 and 3 that is affixed to the telescoping mechanism 48 and bearing blocks 42, 44. The cover 60 covers the telescoping mechanism 48 when it is fully collapsed. The cover 60 has a bottom panel 62, a rear panel 64, and side panels 66, 68 that form a partially enclosed area for the telescoping mechanism 48. The invertible leaf 52 is pivoted to overlay the attached leaf 54 when the telescoping mechanism 48 is fully collapsed. This is shown in FIGS. 7 and 10.

Figure 9:
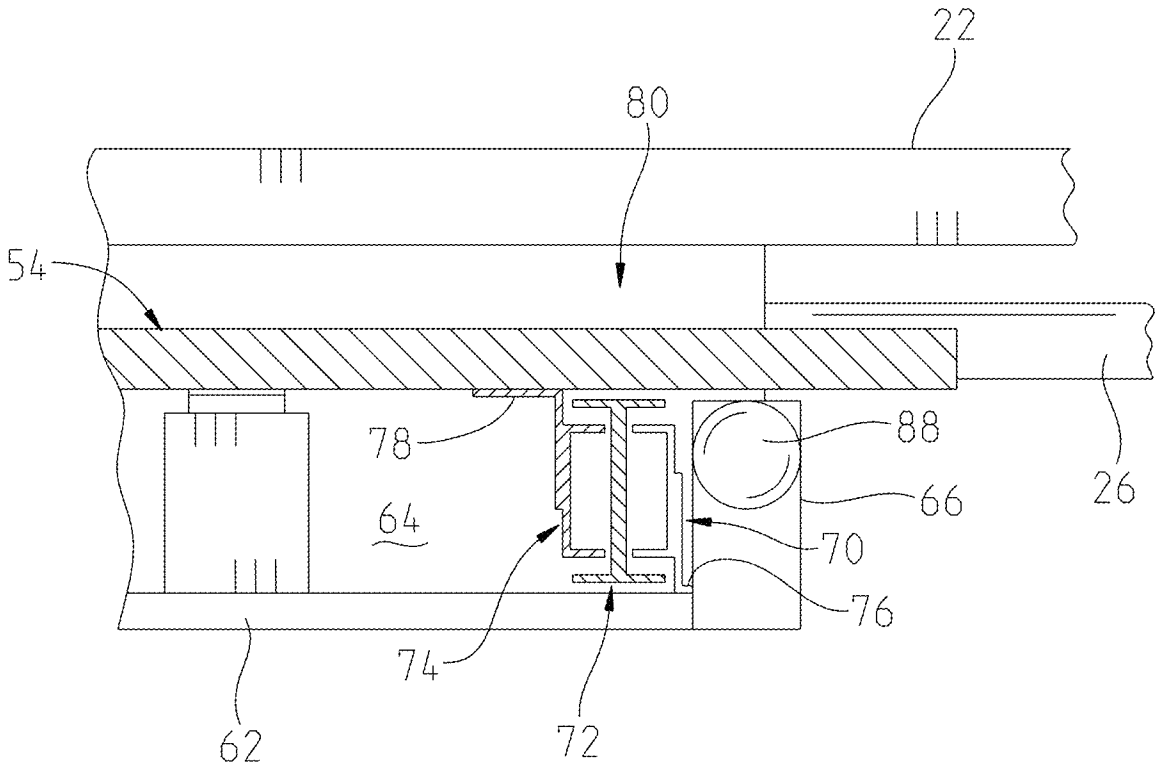
FIG. 9 is a partial section view 9-9 of the sliding desk in FIG. 1.

As seen in FIG. 9, the telescoping mechanism 48 has three sections, a proximal section 70, an intermediate section 72, and a distal section 74. The proximal section 70 includes an integral mounting flange 76 where the cover 60 is attached. The distal section 74 also includes an integral mounting flange 78 to attach the attached leaf 54. As shown in FIG. 5, a gap 80 is located between the bottom surface of the work surface 22 and the top surface of the attached leaf 54. The gap 80 allows clearance for the invertible leaf 52 when it is in the overlay position and the moveable portion 40 is fully collapsed. This is shown in FIG. 7. The invertible leaf 52 moves between an abutting position (shown in FIG. 5) and an overlaying position (shown in FIGS. 7 and 10). When the invertible leaf 52 is in the overlay position, the telescoping mechanism 48 can be moved to the fully compressed position, shown in FIG. 7. When sufficiently pulled away from the fixed portion 20, the invertible leaf 52 is foldable into the abutting position where it abuts the attached leaf 54. In the abutting position, the invertible leaf 52, specifically the second work surface 55, is supported by the telescoping mechanism 48 and/or the side panels 66, 68. It is contemplated that the invertible leaf 52 is not coupled to either the telescoping mechanism 48 or attached leaf 54 so that the user can remove the invertible leaf 52.

As can be seen in the FIGS., at least a portion of the invertible leaf 52 and attached leaf 54 always extend beyond the front edge 25, irrespective of the position of the invertible leaf 52, telescoping mechanism 48, or moveable portion 40.

The hideaway leaf 50 includes a magnetic catch 84 that can be secured to a flag 86 that is affixed to the cover 60. When the hideaway leaf 50 is in the use position as shown in FIG. 5, the catch 84 and flag 86 are engaged to keep the hideaway leaf 50 abutting the invertible leaf 52. In addition, the side panels 66, 68 include a magnetic catch 88, shown in FIG. 2. When the telescoping mechanism 48 is fully collapsed, the support leg 56 contacts the magnetic catch 88 to retain it in the fully collapsed position. In the embodiment shown herein, the support leg 56 is made from steel, which has magnetic properties and will retain the magnetic catch 88.

The desk 10 starts out with the moveable portion 40 in the fully collapsed position with the invertible leaf 52 overlaying the attached leaf 54 and the hideaway leaf 50 in the hidden position, shown in FIG. 7. In addition, the moveable portion 40 can be in either the first or second locked position, with the locking pin 34 engaged with one of the locking plates 32. The user can either slide the moveable portion 40 along the sliding axis 46 or leave the locking pin 34 engaged. To expand the moveable portion 40, the user lifts it up sufficiently for the support leg 56 to clear the floor or other surface while pulling on it to disengage the support leg 56 from the magnetic catch 88. Because the back side of the invertible leaf 52 is a smooth desk surface, the desk 10 can be used when the invertible leaf 52 is in the overlay position. If the user desires additional desk space, they continue to pull to expand the telescoping mechanism 48 enough for the invertible leaf 52 to be pivoted from the overlay position to the abutting position, shown in FIG. 6. If the user desires even more desk space, the telescoping mechanism 48 is expanded further to allow the hideaway leaf 50 to be moved from the hidden position to the use position, shown in FIG. 5.

It is understood that while certain aspects of the disclosed subject matter have been shown and described, the disclosed subject matter is not limited thereto and encompasses various other embodiments and aspects. No specific limitation with respect to the specific embodiments disclosed herein is intended or should be inferred. Modifications may be made to the disclosed subject matter as set forth in the following claims.

What is claimed is:

1. A configurable desk for use with a living space, said configurable desk comprising:

a fixed surface having a front edge, a back edge opposite said front edge, and a rod having a central axis affixed to said fixed surface adjacent said back edge;

a moveable portion coupled to said rod and slidable along said central axis, said moveable portion comprising:

a first telescoping frame having a proximal section located at a fixed distance from said rod and a distal section telescopically extendable with respect to said proximal section in a direction perpendicular to said central axis between a collapsed position and an extended position;

an attached leaf fixed with respect to said distal section of said first telescoping frame, a support leg fixed with respect to said attached leaf;

an invertible leaf hingedly coupled to said attached leaf and pivotable between an abutted position and an overlaying position, said abutted position defined by one edge of said invertible leaf abutting one edge of said attached leaf, said overlaying position defined by said invertible leaf inverted with respect to said abutted position and overlaying said attached leaf;

a second telescoping frame having a proximal section located at a fixed distance from said rod and a distal section telescopically extendable with respect to said proximal section in a direction perpendicular to said central axis between a collapsed position and an extended position; and a hideaway leaf affixed to said distal section of said second telescoping frame, said hideaway leaf is moveable between a hidden position and a use position, said hidden position is defined by said fixed surface overlaying said hideaway leaf and said use position defined by at least a portion of said hideaway leaf extending beyond said front edge;

when said invertible leaf is in said overlaying position, said first telescoping frame is movable to said collapsed position.

2. The desk of claim 1, further comprising a catch to retain said hideaway leaf in said use position.

3. The desk of claim 1, further comprising a catch to retain said first telescoping frame in said collapsed position.

4. The desk of claim 1, wherein said moveable portion has bearing blocks affixed thereto, said bearing blocks are located on and slidable along said rod.

5. The desk of claim 1, wherein said moveable portion is securable from movement along said central axis.

6. The desk of claim 1, wherein said invertible leaf has a first work surface and an oppositely located second work surface, each said work surface is an uninterrupted planar surface.

7. The desk of claim 6, when said invertible leaf is in said abutted position, said first work surface is coplanar with a first work surface of said attached leaf.

8. The desk of claim 1, when said hideaway leaf is in said use position and said invertible leaf is in said overlaying position, movement of said first telescoping frame toward said collapsed position moves said hideaway leaf to said hidden position.

9. A configurable desk comprising:

a fixed surface having a front edge, a back edge opposite said front edge, and a rod affixed to said fixed surface;

a moveable portion coupled to and slidable along said rod, said moveable portion comprising:

an attached leaf telescopically extendable with respect to said rod, a support leg fixed with respect to said attached leaf;

an invertible leaf coupled to said attached leaf and pivotable between an abutted position and an overlaying position, said abutted position defined by said invertible leaf being coplanar to and adjacent said attached leaf, said overlaying position defined by said invertible leaf inverted with respect to said abutted position and overlaying said attached leaf; and a hideaway leaf telescopically moveable between a hidden position and a use position, said hidden position is defined by said fixed surface overlaying said hideaway leaf and said use position defined by a portion of said hideaway leaf extending beyond said front edge;

when said invertible leaf is in said overlaying position and said hideaway leaf is in said hidden position, said attached and invertible leaves are movable towards said rod to abut said hideaway leaf to either said invertible leaf or said attached leaf.

10. The desk of claim 9, further comprising a first telescoping frame telescopically extendable in a direction perpendicular to said rod between a collapsed position and an extended position, said attached leaf affixed to a distal section of said first telescoping frame.

11. The desk of claim 10, further comprising a catch to retain said first telescoping frame in said collapsed position.

12. The desk of claim 9, further comprising a catch to retain said hideaway leaf in said use position.

13. The desk of claim 9, further comprising a second telescoping frame having a proximal section located at a fixed distance from said rod and a distal section telescopically extendable with respect to said proximal section between a collapsed position and an extended position, said hideaway leaf affixed to said distal section.

14. The desk of claim 9, wherein said moveable portion is securable from movement along said rod.

15. The desk of claim 9, wherein said invertible leaf has a first work surface and an oppositely located second work surface, each said work surface is an uninterrupted planar surface.

16. A configurable desk for use with a living space, said configurable desk comprising:

a fixed surface having a front edge, a back edge opposite said front edge;

a moveable portion coupled to said fixed surface and slidable along a central axis, said moveable portion comprising:

a first telescoping frame having a proximal section located at a fixed distance from said central axis and a distal section telescopically extendable with respect to said proximal section between a collapsed position and an extended position;

an attached leaf fixed with respect to said distal section of said first telescoping frame, a support leg fixed with respect to said attached leaf;

an invertible leaf hingedly coupled to said attached leaf and pivotable between an abutted position and an overlaying position, said abutted position defined by one edge of said invertible leaf abutting one edge of said attached leaf and supported by a portion of said first telescoping frame, said overlaying position defined by said invertible leaf inverted with respect to said abutted position and overlaying said attached leaf; and a hideaway leaf telescopically extendable with respect to said fixed surface between a hidden position and a use position, said hidden position is defined by said fixed surface overlaying said hideaway leaf and said use position defined by at least a portion of said hideaway leaf extending beyond said front edge;

when said invertible leaf is in said overlaying position, said first telescoping frame is movable to said collapsed position.

17. The desk of claim 16, wherein said invertible leaf has a first work surface and an oppositely located second work surface, each said work surface is an uninterrupted planar surface.

18. The desk of claim 17, when said invertible leaf is in said abutted position, said first work surface is coplanar with a first work surface of said attached leaf.

19. The desk of claim 16, further comprising a first catch to retain said hideaway leaf in said use position and a second catch to retain said first telescoping frame in said collapsed position.

20. The desk of claim 16, wherein said moveable portion is securable from movement along said central axis.

* * * * *